US007575048B2

(12) United States Patent
Hovelkamp et al.

(10) Patent No.: US 7,575,048 B2
(45) Date of Patent: Aug. 18, 2009

(54) DRIVE FOR A ROTATING CHEMICAL DISPENSING APPARATUS

(75) Inventors: Walter Hovelkamp, Fairview (CA); John Doll, Jr., Fairview (CA)

(73) Assignee: Jolt Energy Solutions Ltd., Alberta (CA)

( * ) Notice: Subject to any disclaimer, the term of this patent is extended or adjusted under 35 U.S.C. 154(b) by 78 days.

(21) Appl. No.: 11/840,895

(22) Filed: Aug. 17, 2007

(65) Prior Publication Data

US 2008/0053650 A1 Mar. 6, 2008

(30) Foreign Application Priority Data

Aug. 31, 2006 (CA) ..... 2558625

(51) Int. Cl.
*E21B 33/03* (2006.01)
*E21B 33/068* (2006.01)

(52) U.S. Cl. ..... 166/75.15; 166/70; 166/310

(58) Field of Classification Search ..... 166/70, 166/310, 75.15
See application file for complete search history.

(56) References Cited

U.S. PATENT DOCUMENTS

| | | | |
|---|---|---|---|
| 4,785,880 | A | 11/1988 | Ashton |
| 5,188,178 | A | 2/1993 | Noyes |
| 6,044,905 | A | 4/2000 | Harrison, III |
| 6,056,058 | A | 5/2000 | Gonzalez |
| 6,182,765 | B1 | 2/2001 | Kilgore |
| 6,269,875 | B1 | 8/2001 | Harrison, III |
| 6,637,512 | B2 | 10/2003 | Casey |

FOREIGN PATENT DOCUMENTS

| | | |
|---|---|---|
| CA | 234310 | 9/1923 |
| CA | 244017 | 10/1924 |
| CA | 2250669 A1 | 11/1999 |
| CA | 2337561 A1 | 8/2001 |
| CA | 2404457 A1 | 3/2004 |
| CA | 2517410 A1 | 2/2006 |

*Primary Examiner*—Giovanna C Wright
(74) *Attorney, Agent, or Firm*—Christensen O'Connor Johnson Kindness PLLC

(57) ABSTRACT

A chemical dispensing apparatus includes a housing and a cartridge support within the housing. A rotating cartridge with chemical stick receptacles is rotatably supported about an axis of rotation by the cartridge support. An injection passage at the bottom of the housing permits chemical sticks to pass from the housing when one of the chemical stick receptacles is in a chemical dispensing position in axial alignment with the injection passage. A drive system rotates the rotating cartridge. The drive system includes a rotational stop biased into engagement with the rotating cartridge, and a pneumatic cylinder having first and second ends. The first end is stationary at a point off-axis from the axis of rotation of the cartridge. The second end has an engagement member, such that as the pneumatic cylinder extends, the engagement member applies a force to one of the chemical stick receptacles to selectively rotate the rotating cartridge.

9 Claims, 3 Drawing Sheets

DRIVE FOR A ROTATING CHEMICAL DISPENSING APPARATUS

FIELD

The present application relates to a drive for a rotating chemical dispensing apparatus for dispensing chemicals into a well.

BACKGROUND

Chemical dispensers are used to inject chemicals into gas well. Some have rotating cartridges to store the chemicals. In U.S. Pat. No. 4,785,880 (Ashton), a moving valve member that also opens and closes the valves engages a sloped cam surface at the top of its stroke to cause the cartridge to rotate. The cam surface is connected to a spring and ratchet surface, such that it returns to its original position after rotating the cartridge. In U.S. Pat. No. 6,269,875 (Harrison, III et al.), the cartridge is rotated by either a motor driving a gear profile on the outside of the cartridge, or a ratchet that is driven by the piston that opens and closes the valves. In U.S. Pat. No. 6,056,058 (Gonzalez), a piston pushes an arm which causes a ratchet system to advance.

SUMMARY

There is provided a chemical dispensing apparatus, including a housing having a bottom and a cover. A cartridge support is within the housing. A rotating cartridge is rotatably supported about an axis of rotation by the cartridge support. The rotating cartridge has chemical stick receptacles. An injection passage is provided at the bottom of the housing, and is adapted to permit chemical sticks to pass from the housing when the rotating cartridge is rotated to bring one of the chemical stick receptacles into a chemical dispensing position in axial alignment with the injection passage. A drive system for rotating the rotating cartridge is provided. The drive system includes a rotational stop, and means for biasing the rotational stop into engagement with the rotating cartridge. A pneumatic cylinder having a first end and a second end is provided. The first end is stationary relative to the housing at a point off-axis from the axis of rotation of the rotating cartridge. The second end has an engagement member, such that as the pneumatic cylinder extends, the engagement member at the second end applies a force to one of the chemical stick receptacles to overcome the biasing force acting upon the rotational stop and selectively rotate the rotating cartridge.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 2:
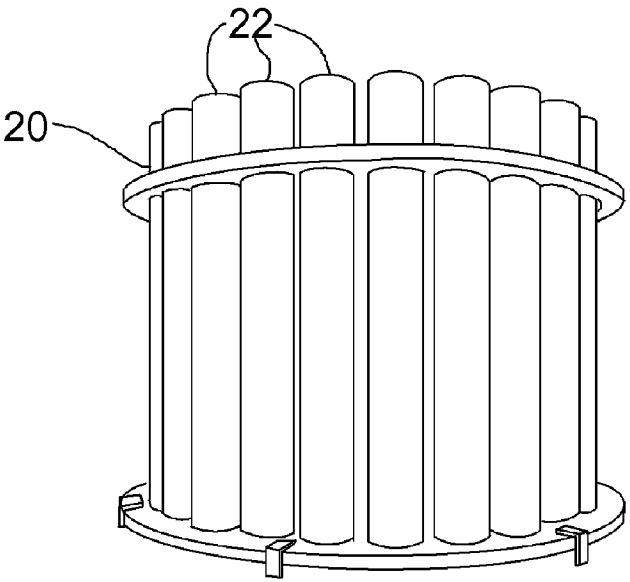
FIG. 2 is a side elevation view of a rotating cartridge.

A chemical dispensing apparatus generally identified by reference numeral 10, will now be described with reference to FIG. 1 through 5.

Figure 1:
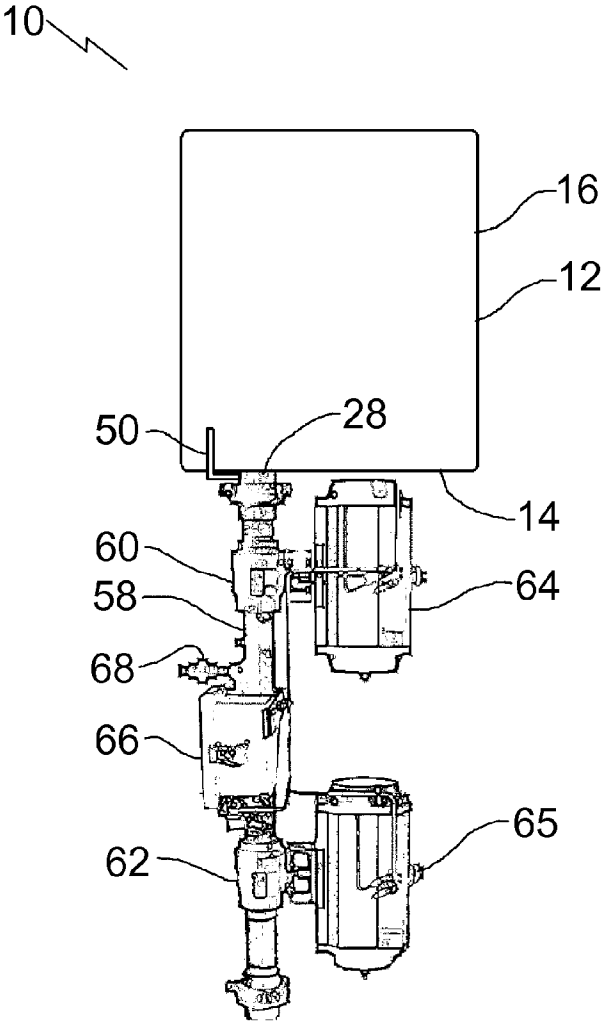
FIG. 1 is a front elevation view of the chemical dispensing apparatus.
Figure 3:
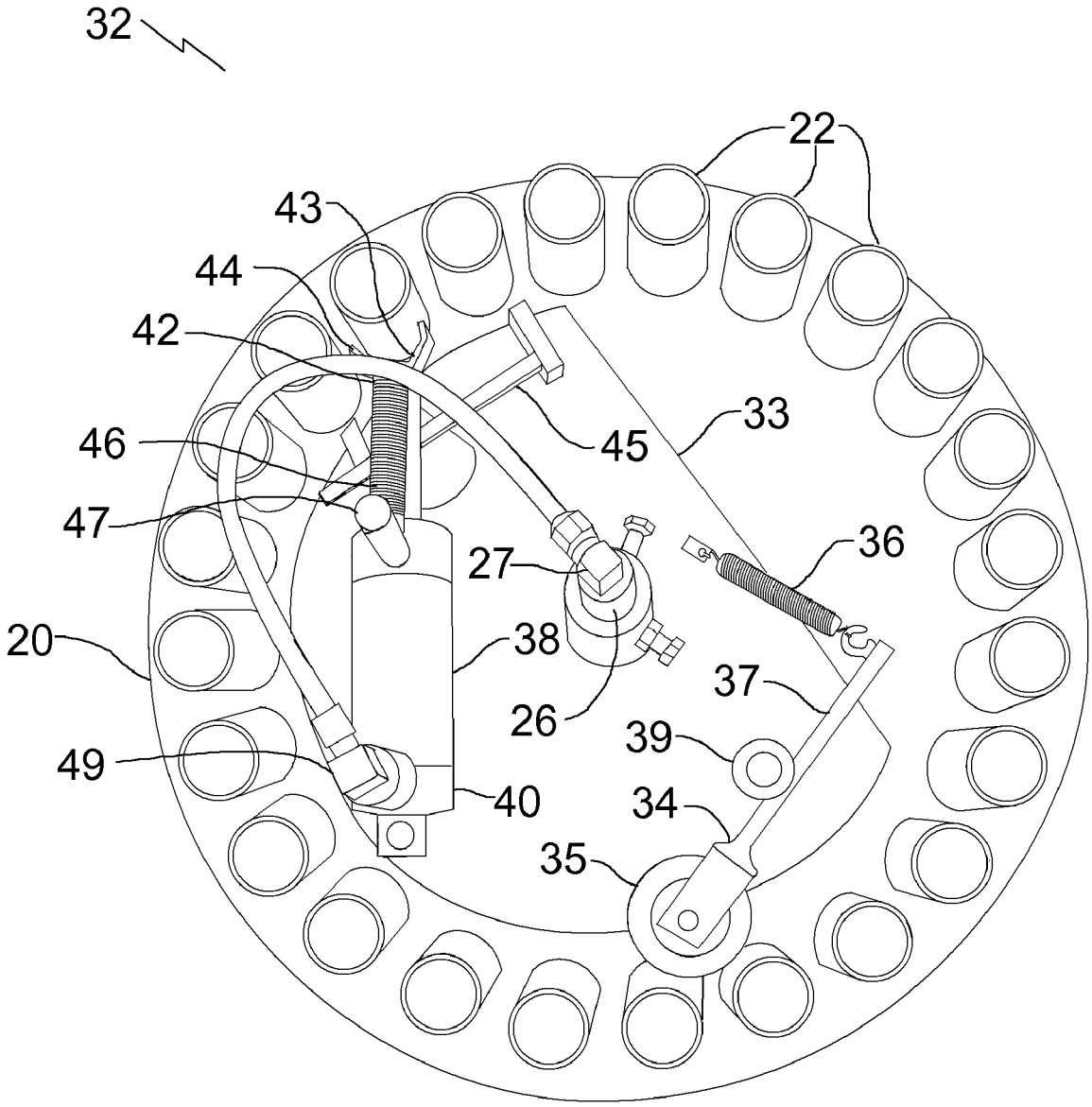
FIG. 3 is a top plan view of the drive system.
Figure 4:
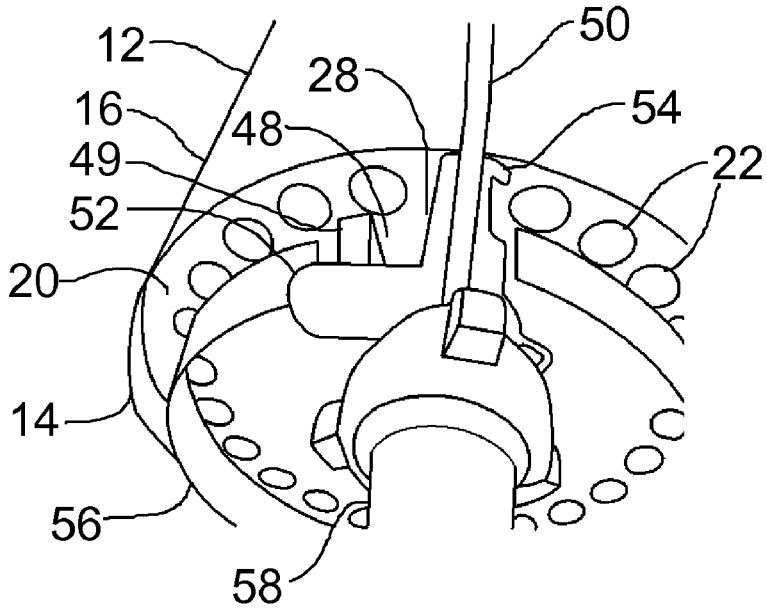
FIG. 4 is a detailed perspective view of the injection passage with the loading lever in the closed position.
Figure 5:
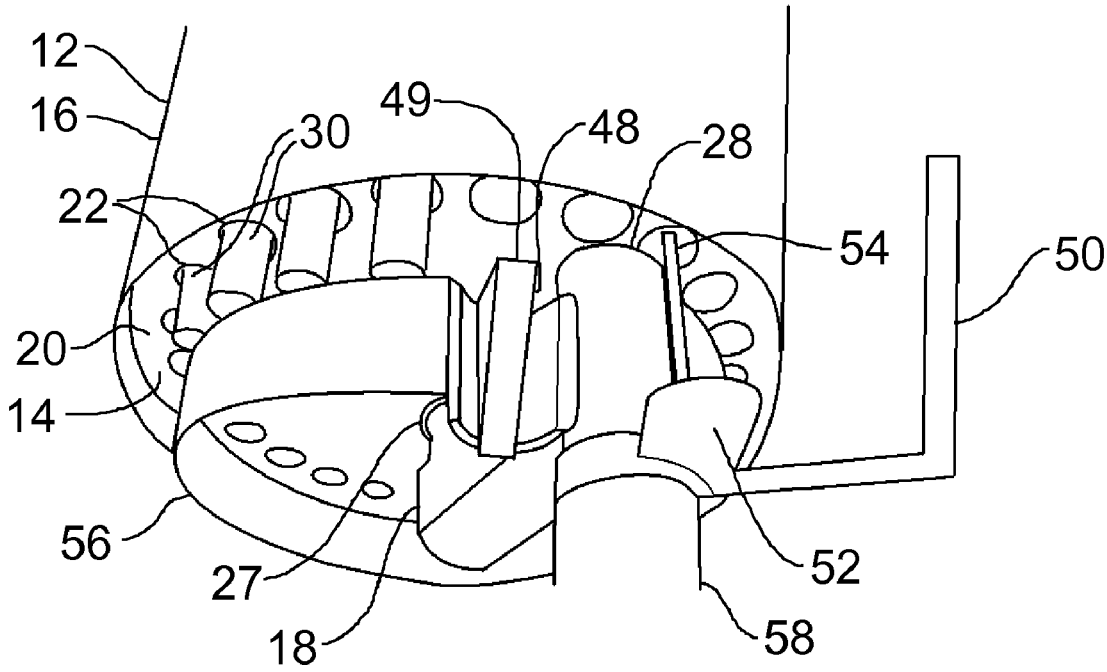
FIG. 5 is a detailed perspective view of the injection passage with the loading lever in the open position.

Structure and Relationship of Parts:

Referring to FIG. 1, a chemical dispensing apparatus 10 includes a housing 12 having a bottom 14 and a cover 16. Referring to FIG. 5, a cartridge support 18 is positioned within housing 12. A rotating cartridge 20 with chemical stick receptacles 22 in the form of tubes is rotatably supported by cartridge support 18. Referring to FIG. 2, rotating cartridge 20 is shown in detail. Referring to FIG. 3, rotating cartridge 20 is supported about an axis of rotation defined by a rod 26 that extends through cartridge 20 along its axis of rotation. Bearings (not shown) facilitate the rotation of cartridge 20 about stationary rod 26. Referring to FIG. 4 and FIG. 5, chemical sticks 30 are supported on a ring shaped rail 56. Rail 56 is preferred as an underlying support surface, in order to minimize a build up of chemical which occurs due to friction, as chemical sticks 30 are rubbed along an underlying supporting surface during rotation of cartridge 20. An injection passage 28 is provided below bottom 14 of housing 12 and is adapted to permit chemical sticks 30 to pass from housing 12 when rotating cartridge 20 is rotated to bring one of the chemical stick receptacles 22 into a chemical dispensing position in axial alignment with injection passage 28. Chemical sticks 30 are preferably cylindrical in shape, and may be soap sticks, acid sticks, condensation sticks, $H_2S$ sticks, or the like.

Referring to FIG. 3, a drive system 32 rotates rotating cartridge 20. Drive system 32 includes a rotational stop 34 and means, such as a spring 36 for biasing rotational stop 34 into engagement between receptacles 22 of rotating cartridge 20. Drive system 32 is mounted on a plate 33 shaped like a "D" that is attached to rod 26 and not to cartridge 20, such that cartridge 20 is able to move relative drive system 32. Rotational stop 34 is a wheel 35 mounted on an arm 37 biased by spring 36 to maintain wheel 35 in engagement with rotating cartridge 20 as arm 37 pivots about a pivot point 39. A pneumatic cylinder 38 has a first end 40 and a second end 42. The first end 40 is secured to plate 33 so it is stationary relative to housing 12 at a point off-axis from the axis of rotation of rotating cartridge 20. Second end 42 has an engagement member 44 with an arcuate face 43 adapted to engage receptacles 22. As pneumatic cylinder 38 extends, engagement member 44 at second end 42 applies a force to one of the chemical stick receptacles 22 to overcome the biasing force acting upon rotational stop 34 and selectively rotate rotating cartridge 20. A guide 45 is used to align second end 42 of pneumatic cylinder 38 with chemical stick receptacles 22. As shown, pneumatic cylinder 38 is a single-acting piston biased in a retracted position by a spring 46. Pneumatic cylinder 38 also includes a vent 47 and a check valve 49 that allows a slow bleed off. Because cover 16 is shown in FIG. 1 as fully covering drive system 32 as well as rotating cartridge 20, pneumatic pressure may be fed to cylinder 38 through rod 26, which is hollow and has fittings 27 at each end. The actuation of pneumatic cylinder 38 is preferably controlled by timer 66 which also controls valves 60 and 62 as described below.

Referring to FIGS. 4 and 5, to load chemical sticks 30 into chemical stick receptacles 22 of rotating cartridge 20, a loading port 48 is provided in bottom 14 of housing 12. A wedge shaped stop 49 is positioned in loading port 48. Wedge shaped stop 49 enables chemical sticks 30 to pass up through loading port 48, but prevents chemical sticks 30 from falling back down through loading port 48, as cartridge 20 is rotated to position chemical sticks on rail 31 Cartridge 20 is designed to be bottom loaded for ease of operation and the safety of the operator. A loading lever 50 has a closed position shown in FIG. 4 and an open position shown in FIG. 5. Loading lever 50 also controls a loading block 52 that prevents access to loading port 48 when loading lever 50 is in the closed position, and a chemical stick stop 54 that prevents any unwanted injections through injection passage 28 when loading lever 50 is in the open position, by moving into the path of chemical sticks 30. As previously described, bottom 14 includes a narrow chemical stick support rail 56, which is designed to prevent any chemical build-up as chemical sticks 30 slide along rail 56.

Referring to FIG. 1, chemical sticks 30 are injected into a well (not shown) by connecting injection passage 28 and the well through a conduit 58. Conduit 58 has a top valve 60 and a bottom valve 62. For safety reasons, valves 60 and 62 are fail close ball valves. Controls, such as a valve controller 64 for top valve 60 and a valve controller 65 for bottom valve 62 are provided to ensure that when top valve 60 is open, bottom valve 62 is closed, and when bottom valve 62 is open, top valve 60 is closed. This is done by providing a timer 66 that opens and closes valves 60 and 62 at specified intervals to allow chemical sticks 30 to pass from an open atmosphere into the pressurized well bore. Conduit 58 also has a vent 68 disposed between top valve 60 and bottom valve 62. Vent 68 provides means for selectively relieving any pressure in conduit 58 between top valve 60 and bottom valve 62.

Operation:

The use and operation of chemical dispensing apparatus 10 as described above with reference to FIG. 1 through 5 will now be discussed. Referring to FIGS. 4 and 5, loading lever 50 is moved from the closed position shown in FIG. 4 to the open position in FIG. 5, such that loading block 52 no longer prevents access to loading port 48, and chemical stick stop 54 prevents any unwanted injections during loading. Cartridge 20 is rotated counter clockwise by hand such that the last filled receptacle 22 is adjacent to loading port 48. A chemical stick 30 is then inserted through loading port 48 past wedge shaped stop 49 into the open receptacle 22. Rotating cartridge 20 is rotated one position clockwise to position chemical stick 30 on support rail 56 and cartridge 20 so that the next receptacle 22 may be filled. Once cartridge 20 has been appropriately filled, loading lever 50 is then returned to the closed position, and chemical dispensing apparatus 10 may be used to inject chemical sticks 30 into a wellbore. Referring to FIGS. 1 and 3, timer 66 causes pneumatic cylinder 38 to extend such that arcuate face 43 on second end 42 of pneumatic cylinder 38 engages one of the receptacles 22, causing rotating cartridge 20 to rotate. Spring 46 causes second end 42 to retract once cartridge 20 has been rotated. As rotating cartridge 20 is being pushed to rotate, the force that spring 36 applies to rotational stop 34 is overcome, such that wheel 35 retracts about pivot point 39 and becomes engaged between the next two receptacles as cartridge 20 rotates. Rotational stop 34 then maintains rotating cartridge 20 in position until further force is applied. Referring to FIG. 5, once rotating cartridge is in its new position, a receptacle 22 loaded with a chemical stick 30 will be positioned in axial alignment with injection passage 28 of conduit 58. Referring to FIG. 1, timer sends a control signal to cause valve controller 64 to open top valve 60 to open while bottom valve 62 is closed, allowing chemical stick 30 to enter conduit 58. Top valve 60 may then be closed, and bottom valve 62 is free to be opened by valve controller 65 to allow chemical stick 30 to enter the pressurized wellbore. A time delay is always provided between the closing of top valve 60 and the opening of bottom valve 62. Once bottom valve 62 is again closed, pressure between top valve 60 and bottom valve 62 is released through vent 47, which may be fitted with a gas scrubber to neutralize sour gas before it is vented. Suitable results have been obtained by opening top valve 60 for 30 seconds, and opening bottom valve 62 for 30 seconds, once top valve 60 has been closed for 60 seconds.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope defined in the Claims.

What is claimed is:

1. A chemical dispensing apparatus, comprising:

a housing having a bottom and a cover;

a cartridge support within the housing;

a rotating cartridge rotatably supported about an axis of rotation by the cartridge support, the rotating cartridge having chemical stick receptacles;

an injection passage at the bottom of the housing, adapted to permit chemical sticks to pass from the housing when the rotating cartridge is rotated to bring one of the chemical stick receptacles into a chemical dispensing position in axial alignment with the injection passage;

a drive system for rotating the rotating cartridge, the drive system comprising:

a rotational stop;

means for biasing the rotational stop into engagement with the rotating cartridge;

a pneumatic cylinder having a first end and a second end, the first end being stationary relative to the housing at a point off-axis from the axis of rotation of the rotating cartridge, the second end having an engagement member, such that as the pneumatic cylinder extends, the engagement member at the second end applies a force to one of the chemical stick receptacles to overcome the biasing force acting upon the rotational stop and selectively rotate the rotating cartridge.

2. The chemical dispensing apparatus of claim 1, wherein a loading port is provided in the bottom of the housing, through which chemical sticks are loaded into the chemical stick receptacles of the rotating cartridge.

3. The chemical dispensing apparatus of claim 1, wherein the injection passage is connected to a conduit adapted for connection to a well.

4. The chemical dispensing apparatus of claim 3, wherein the conduit has a top valve, a bottom valve, controls being provided to ensure that when the top valve is open the bottom valve is closed and when the bottom valve is opened the top valve is closed.

5. The chemical dispensing apparatus of claim 4, wherein the conduit has a vent disposed between the top valve and the bottom valve, the vent providing means for selectively relieving any pressure in the conduit between the top valve and the bottom valve.

6. The chemical dispensing apparatus of claim 1, wherein the chemical stick receptacles are tubes.

7. The chemical dispensing apparatus of claim 6, wherein the engagement member at the second end of the pneumatic cylinder has an arcuate face adapted to engage the tubes.

8. The chemical dispensing apparatus of claim 1, wherein the rotational stop is a wheel mounted on an arm and the means for biasing the rotational stop comprises a spring, the arm being biased by the spring to maintain the wheel in engagement with the rotating cartridge.

9. The chemical dispensing apparatus of claim 1, wherein the pneumatic cylinder is a single-acting piston biased in a retracted position by a spring.

* * * * *